US009354542B2

(12) United States Patent
You

(10) Patent No.: US 9,354,542 B2
(45) Date of Patent: May 31, 2016

(54) IMAGE FORMING APPARATUS

(71) Applicant: Samsung Electronics Co., Ltd., Suwon-si (KR)

(72) Inventor: Ho Gun You, Hwaseong-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/561,819

(22) Filed: Dec. 5, 2014

(65) Prior Publication Data

US 2015/0177640 A1 Jun. 25, 2015

(30) Foreign Application Priority Data

Dec. 20, 2013 (KR) ..... 10-2013-0160686

(51) Int. Cl.
*G03G 15/00* (2006.01)
*G03G 15/043* (2006.01)
*G03G 21/16* (2006.01)

(52) U.S. Cl.
CPC ..... *G03G 15/0435* (2013.01); *G03G 21/1666* (2013.01); *G03G 21/1676* (2013.01); *G03G 21/1647* (2013.01)

(58) Field of Classification Search
CPC ..... G03G 2221/1684; G03G 2221/1633; G03G 21/1853; G03G 21/1647; G03G 21/1623
USPC ..... 399/110
See application file for complete search history.

(56) References Cited

U.S. PATENT DOCUMENTS

| | | | | |
|---|---|---|---|---|
| 8,027,620 | B2 * | 9/2011 | Sakuma | 399/258 |
| 2004/0124575 | A1 * | 7/2004 | Lee et al. | 271/10.01 |
| 2007/0077086 | A1 * | 4/2007 | Takakuwa et al. | 399/111 |
| 2008/0187350 | A1 * | 8/2008 | Lim | 399/99 |
| 2010/0316395 | A1 * | 12/2010 | Hayashi | 399/9 |
| 2011/0026989 | A1 * | 2/2011 | Chiba | 399/329 |

* cited by examiner

*Primary Examiner* — Walter L Lindsay, Jr.
*Assistant Examiner* — Frederick Wenderoth
(74) *Attorney, Agent, or Firm* — Staas & Halsey LLP

(57) ABSTRACT

An image forming apparatus includes at least one developing device which may include a photoconductor and a developing roller, a light source configured to generate light to form an electrostatic latent image, a light scanner including a light window through which the light generated by the light source is transmitted, a shutter configured to open or close the light window, and a pressure member moved in response to the opening or closing operation of the shutter or the contact or separation between the photoconductor and the developing roller. The image forming apparatus can easily control the shutter without additional structures, resulting in implementation of a simplified structure.

21 Claims, 14 Drawing Sheets

IMAGE FORMING APPARATUS

CROSS-REFERENCE TO RELATED APPLICATIONS

This application claims the priority benefit of Korean Patent Application No. 10-2013-0160686, filed on Dec. 20, 2013 in the Korean Intellectual Property Office, the disclosure of which is incorporated herein by reference.

BACKGROUND

1. Field

Embodiments relate to an image forming apparatus for improving an operation structure.

2. Description of the Related Art

Image forming apparatuses form an image on a printing medium according to an input signal, and correspond to a printer, a copier, a facsimile and a multi-function apparatus combining functions thereof.

An electrophotographic image forming apparatus which is one kind of image forming apparatus includes photoconductor units including photoconductors, charging units arranged around the photoconductor units and charging the photoconductors with a designated electric potential, developing units including developing rollers, and a laser scanning unit. The light scanning unit irradiates light to the photoconductors charged with the designated electric potential by the charging units to form electrostatic latent images on the surfaces of the photoconductors, and the developing units supply toners serving as developers to the photoconductors on which the electrostatic latent images are formed to form visible images on the photoconductors.

In the case of an image forming apparatus having a structure in which toners are supplied to photoconductors by contact between developing rollers and the photoconductors, the developing rollers and the photoconductors contact each other if a printing operation is executed, and the developing rollers and the photoconductors are separated from each other so as to prevent interference between the developing rollers and the photoconductors if the developing units are replaced.

Toner is accumulated at the light scanning unit for irradiating light to a photoconductor, which may degrade image quality or cause the occurrence of white lines in images.

SUMMARY

In an aspect of one or more embodiments, there is provided an image forming apparatus having an improved structure so as to clean a light scanner without using additional structures.

In an aspect of one or more embodiments, there is provided an image forming apparatus which includes: a main body; a developing device including a photoconductor and a developing roller that forms a visible image by applying a toner to the photoconductor on which an electrostatic latent image is formed and is detachably coupled to the photoconductor; a light scanner which includes a light source which generates light to form the electrostatic latent image by applying the light to the photoconductor, and a light window transmitting the light generated by the light source; a shutter provided to open or close the light window; and a pressure member which includes a pressure-member main body provided to move forward or backward between a first position and a second position, and also a pressure protrusion provided to press the shutter and the developing device, wherein the pressure-member main body is interoperable with an opening or closing operation of the shutter or a contact or separation between the photoconductor and the developing roller.

At the first position, the photoconductor and the developing roller may contact each other and the shutter may open the light window. At the second position, the photoconductor and the developing roller may be separated from each other and the shutter may close the light window.

The pressure member may separate the photoconductor from the developing roller by pressing the developing device after moving in a first direction, and may close the light window by pressing the shutter. The pressure member may release pressure applied to the developing device by moving to a second direction opposite to the first direction in such a manner that the photoconductor and the developing roller contact each other, and may open the light window by releasing pressure applied to the shutter.

The shutter may include a pressed part pressed through the pressure protrusion such that the shutter is opened or closed. The developing device may include: a separation protrusion pressed through the pressure protrusion in such a manner that the developing roller and the photoconductor contact each other or are separated from each other. The pressed part and the separation protrusion may be pressed by the pressure protrusion in response to movement of the pressure member moving from the open position to the close position.

The pressure protrusion may simultaneously press the pressed part and the separation protrusion.

The developing device may include: a photoconductor unit including the photoconductor; and a developing unit including the developing roller, and rotatably provided at the photoconductor unit so that the photoconductor and the developing roller contact each other or are separated from each other by the pressure member. The pressure member may rotate the developing unit by pressing one side of the developing unit such that the developing roller and the photoconductor are separated from each other.

The shutter may be rotatably moved among a standby position, an open position at which the light window is opened when the link device moves from the standby position due to installation of the developing device, and a close position at which the light window is closed.

The shutter may include: a shutter-unit main body to open or close the light window; and a link device rotatably coupled to the shutter-unit main body so that the link device moves among the standby position, the open position, and the close position. The link device may include: a mounting protrusion pressed by the developing device when the developing device is mounted so that the shutter is protruded to move from the standby position to the open position.

The shutter may rotatably move between the open position and the close position due to movement of the pressure member.

The link device may include a first link member located upstream of a direction along which the developing device is mounted; and a second link member located downstream of the direction along which the developing device is mounted, wherein the mounting protrusion is provided at the second link member.

The shutter may further include a light guide hole provided in the shutter-unit main body so that light transmitted through the light window passes through the light guide hole.

The shutter may further include: a cleaning member corresponding to the light window so as to clean the light window in response to rotation of the shutter.

The shutter may rotatably move between the open position at which the light window is opened and the close position at which the light window is blocked. The cleaning member may be located downstream of the light guide hole in response to movement of the shutter configured to move from the open position to the close position.

The image forming apparatus may further include a motor to generate power; and a power clutch to selectively apply power generated by the motor to the pressure member.

The developing device may be detachably coupled to an upper part of the light scanner, and the shutter may be disposed between the developing device and the light scanner.

The image forming apparatus may further include: a fixing member to guide movement of the pressure member at one side of the pressure member; and a position control sensor to detect a distance difference between a first position of the fixing member and a second position corresponding to the first position of the pressure member.

In an aspect of one or more embodiments, there is provided an image forming apparatus includes: a main body; a photoconductor unit including a photoconductor; a developing unit, rotatably coupled to the photoconductor unit, i which includes a developing roller that forms a visible image by applying a toner to the photoconductor on which an electrostatic latent image is formed so that the developing roller is detachably coupled to the photoconductor, and a separation protrusion pressed so that the developing unit rotates; a light scanner which includes a light source which generates light to form an electrostatic latent image by applying the light to the photoconductor, and a light window which transmits the light generated by the light source; a shutter, rotatably provided to open or close the light window, which includes a pressed part configured to be pressed so that the shutter rotatably moves; and a pressure member which includes a pressure-member main body provided to be rotatably moved forward or backward, an a pressure protrusion protruded from the pressure-member main body to press the separation protrusion and the pressed part.

The shutter may include a shutter-unit main body to open or close the light window. The pressed part may protrude from the shutter-unit main body, and may be directly pressed by the pressure protrusion.

The shutter may be a link device rotatably coupled to the shutter-unit main body, and may be rotatably moved among a standby position, an open position at which the light window is opened when the link device moves from the standby position due to installation of the developing device, and a close position at which the light window is closed.

The shutter may move from the standby position to the open position when the developing device is mounted, and may move between the open position and the close position when the pressure member moves forward or backward.

The link device may include: a mounting protrusion pressed by the developing device when the developing device is mounted so that the shutter is protruded to move from the standby position to the open position.

In an aspect of one or more embodiments, there is provided an image forming apparatus which includes: a main body; a developing device including a photoconductor and a developing roller that forms a visible image by applying a toner to the photoconductor on which an electrostatic latent image is formed and is detachably coupled to the main body; a light scanner which includes a light source generating light to form the electrostatic latent image by applying the light to the photoconductor, and a light window transmitting the light generated by the light source; and a shutter rotatably moved among a standby position achieved when the developing device is not mounted, an open position at which the light window is opened, and a close position at which the light window is blocked, and moved from the standby position to the open position in response to movement of the developing device mounted to the main body.

The shutter may include: a shutter-unit main body corresponding to the light window such that the light window is opened or closed; a link device configured to include not only a first link member located upstream of a direction along which the developing device is mounted, but also a second link member located downstream of the direction along which the developing device is mounted, such that the shutter is rotatably moved among the standby position, the open position, and the close position; and a mounting protrusion provided at the second link member, and pressed by the developing device due to installation of the developing device in such a manner that the shutter is rotatably moved from the standby position to the open position.

The image forming apparatus may further include: a photoconductor unit including the photoconductor; and a developing unit including the developing roller, and rotatably coupled to the photoconductor unit in such a manner that the photoconductor and the developing roller are in contact with each other or separated from each other by the pressure member.

The image forming apparatus may further include: a pressure member to press the developing unit and the shutter in a first direction so that the photoconductor and the developing roller are separated from each other and the shutter closes the light window, and to release pressure applied to the developing unit and the shutter in a second direction opposite to the first direction so that the photoconductor contacts the developing roller and the shutter opens the light window.

The pressure member may include: a pressure-member main body configured to move forward or backward; and a pressure protrusion protruded from the pressure-member main body to face the shutter and the developer, thereby pressing the shutter and the developing unit.

The shutter unit may include a cleaning member arranged to correspond to the light window so as to clean the light window in response to movement of the shutter unit moving between the open position and the close position.

BRIEF DESCRIPTION OF THE DRAWINGS

These and/or other aspects of will become apparent and more readily appreciated from the following description of embodiments, taken in conjunction with the accompanying drawings of which.

DETAILED DESCRIPTION

Figure 1:
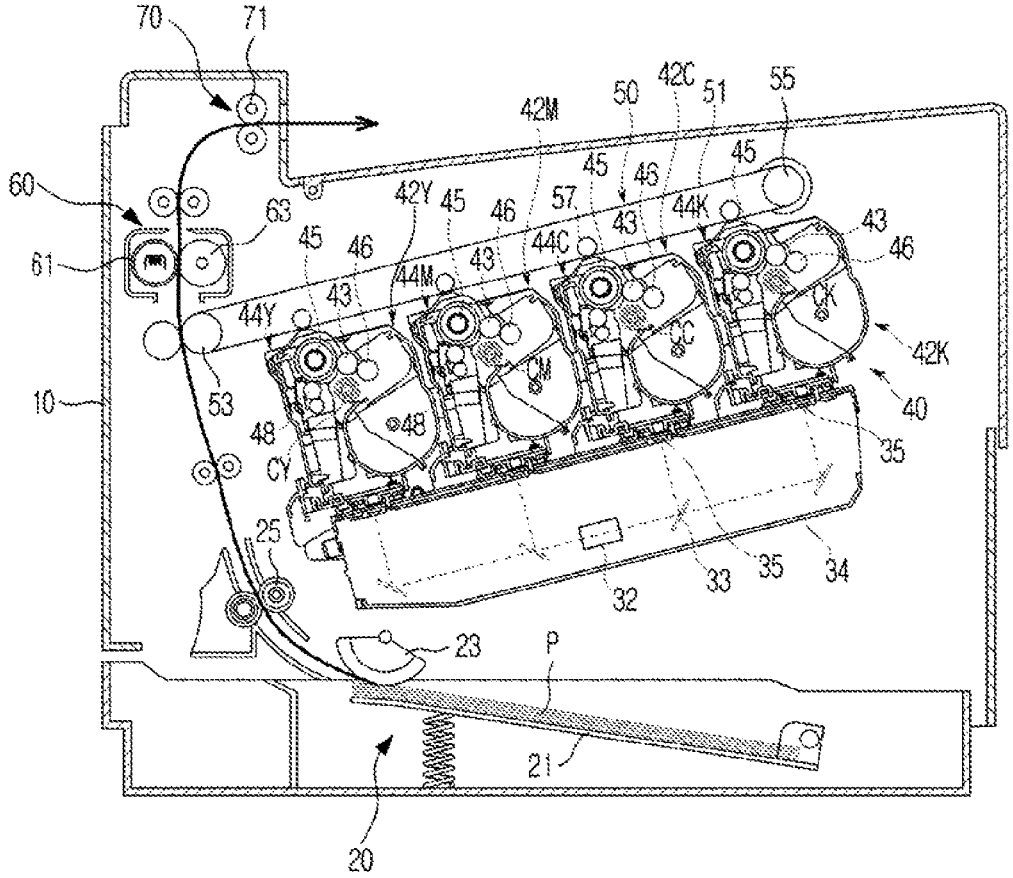
FIG. 1 is a structural diagram illustrating an image forming apparatus according to an exemplary embodiment.

Reference will now be made in detail to exemplary embodiments, examples of which are illustrated in the accompanying drawings, wherein like reference numerals refer to like elements throughout.

FIG. 1 is a structural diagram illustrating an image forming apparatus according to an exemplary embodiment.

Referring to FIG. 1, the image forming apparatus includes a main body 10, a paper supply unit (paper supplier) 20, a light scanning unit (light scanner) 30, a developing device 40, a transfer unit 50, a fusing unit (fuser) 60, and a paper discharge unit (paper discharger) 70.

The main body 10 supports various components disposed therein while forming the external appearance of the image forming apparatus.

The paper supply unit 20 includes a cassette 21 to store sheets of paper S, a pickup roller 23 to pick up the sheets of paper S stored in the cassette 21 one by one, and a feed roller 25 to feed each picked-up sheet of paper to the developing device 40.

The developing device 40 includes four developing units (developers) 42Y, 42M, 42C, and 42K and four photoconductor units 44Y, 44M, 44C, and 44K.

The developing units 42Y, 42M, 42C, and 42K respectively include toners of different colors, for example, yellow (Y), magenta (M), cyan (C), and black (B). Each of the developing units 42Y, 42M, 42C and 42K includes a developing roller 43 and a supply roller 46. The supply roller 46 supplies the toners to the developing roller 43. The developing roller 43 attaches the toners to a surface of the photoconductor 45 on which an electrostatic latent image is formed and thus forms a visible image.

Each of the photoconductor units 42Y, 42M, 42C and 42Y respectively corresponding to the developing units 44Y, 44M, 44C and 44Y includes a photoconductor 45 and a charger 48. The charger 48 charges the photoconductor 45 with a designated electric potential, and an electrostatic latent image is formed on the surface of the photoconductor 45 charged by the charger 48.

The developing device 40 may be detachably connected to one side of the main body 10. When the developing device 40 is mounted in the main body 10, the respective developing units 42Y, 42M, 42C and 42K are combined with the respective photoconductor units 44Y, 44M, 44C and 44K so as to be rotatable about the centers of rotation CY, CM, CC and CK. In accordance with the embodiment, the developing device 40 may be mounted to a inner frame 12 contained in the main body.

The developing rollers 43 of the respective developing units 42Y, 42M, 42C and 42K contact the photoconductors 45 of the respective photoconductor units 44Y, 44M, 44C and 44K when the image forming apparatus performs a printing operation, and are separated from the photoconductors 45 of the respective photoconductor units 44Y, 44M, 44C and 44K when the respective photoconductor units 42Y, 42M, 42C and 42K are separated from the main body 10 for replacement.

The light scanning unit 30 may radiate light corresponding to image information including yellow (Y), magenta (M), cyan (C), and black (K) to the photoconductors 45 of the developing devices.

In an embodiment, the light scanning unit 30 is arranged under the developing device 40, and radiates light corresponding to image information to photoconductors 45 to form electrostatic latent images on the surfaces of the photoconductors 45. The light scanning unit 30 includes a light source 32 generating light, a plurality of reflective mirrors 33 changing the path of the light generated by the light source 32, and a plurality of light windows 35 transmitting light reflected by the reflective mirrors 33.

The case 34 may be provided with a light window 35 such that light emitted from the light source 32 is transmitted to the photoconductor 45 of each developing device 40.

The transfer unit 50 may include a transfer belt 51 to circulate in contact with the photoconductor 45 of each developing device 40, a drive roller 53 to drive the transfer belt 51, a tension roller 55 to apply a constant tension to the transfer belt 51, and four rollers 57 to transfer a toner image developed on the photoconductor 45 of each developing unit 40 to the printing medium P.

The fusing unit 60 includes a heating roller 61 containing a heat source to heat the printing medium P to which the toner has been transferred, and a pressure roller 63 installed to face the heating roller 61 to maintain a constant fusing pressure between the heating roller 61 and the pressure roller 63.

The paper discharge unit 70 may include a plurality of discharge rollers 71 to discharge the printing medium P, on which the image has completely been formed, to the outside of the main body 10.

With the above-described configuration, as the printing medium P, picked up by the paper supply unit 20, is delivered to the developing device 40, a color image is transferred from the photoconductor 45 of each developing device 40 to the printing medium P and after the fusing unit 60 fuses the color image to the printing medium P, the paper discharge unit 70 discharges the printing medium P to the outside of the main body 10.

During the above-described operation of the image forming apparatus, the main body 10 may become contaminated with various impurities, such as toner dust or dirt introduced from the outside, and these impurities may be adhered to the light window 35 of the light scanning unit 30.

The image forming apparatus according to this embodiment may include a shutter unit 120 (shutter). The shutter unit 120 may prevent foreign materials from adhering to the light window 35 of the light scanning unit 30 or may remove the adhered foreign materials.

Figure 2:
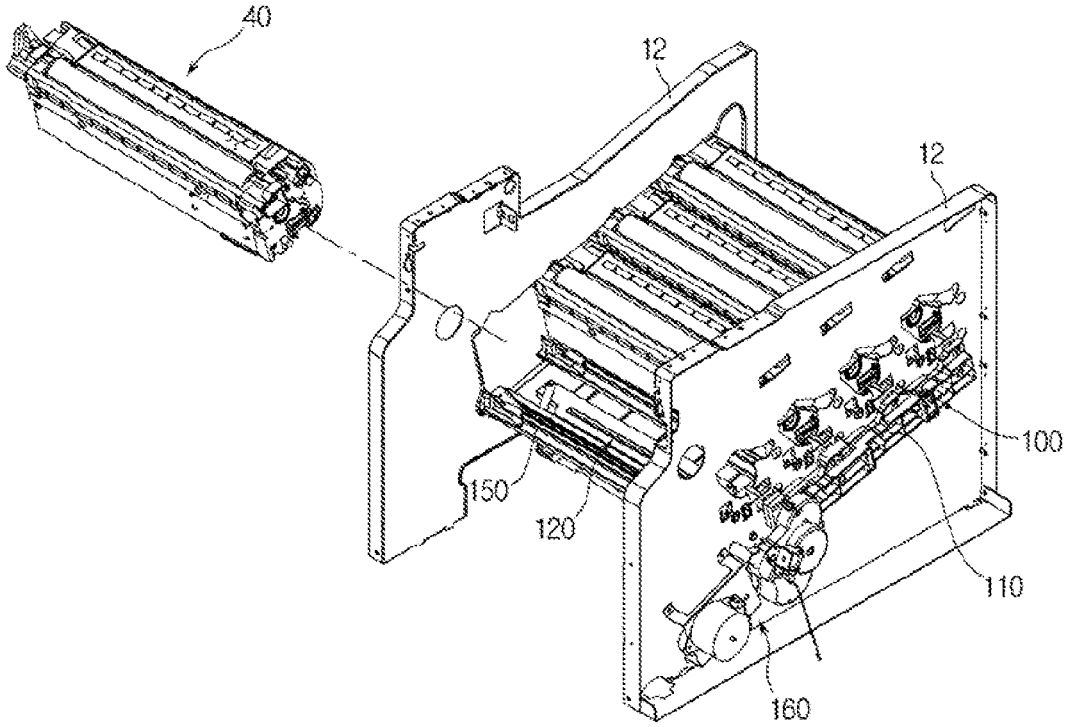
FIG. 2 is a perspective view illustrating some constituent elements of the image forming apparatus according to an exemplary embodiment.
Figure 3:
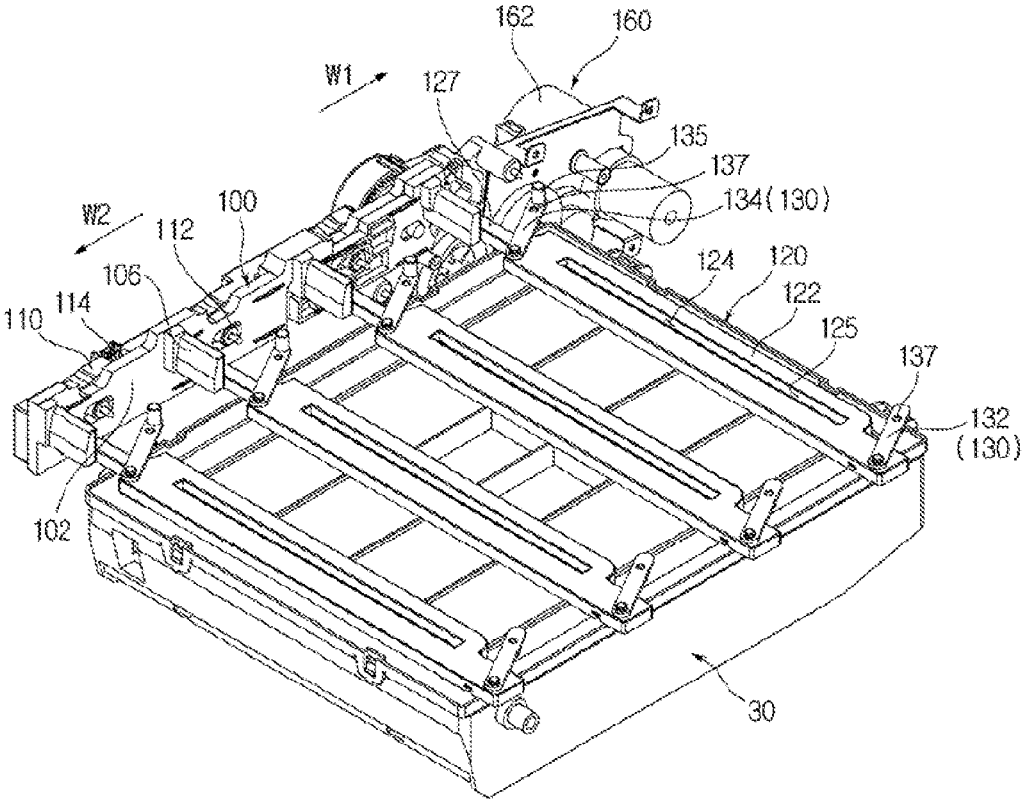
FIG. 3 is a perspective view illustrating some constituent elements of the image forming apparatus according to an exemplary embodiment.
Figure 4:
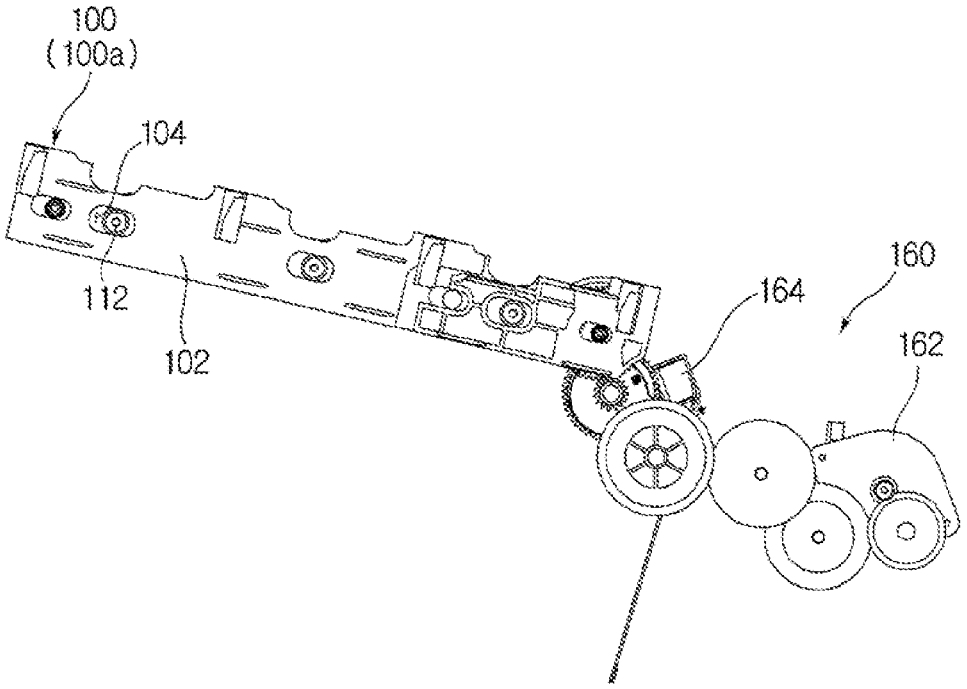
FIGS. 4 and 5 are views illustrating operations of a pressure member according to an exemplary embodiment.
Figure 5:
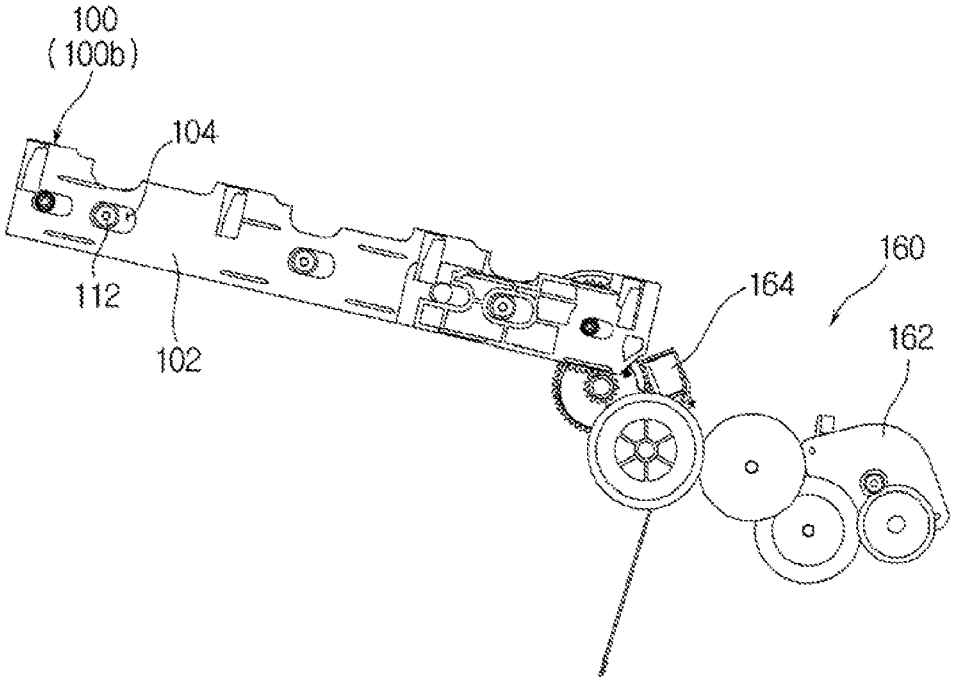
Figure 6:
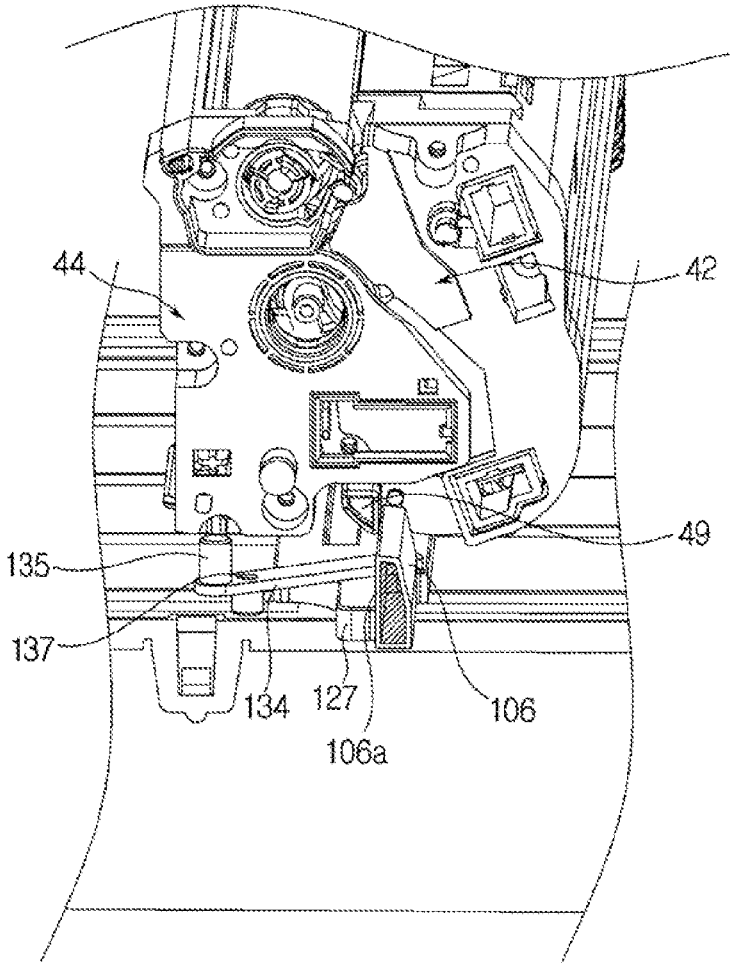
FIG. 6 is a view illustrating a pressure member, a developing device, and a cleaning member of the image forming apparatus according to an exemplary embodiment.
Figure 7:
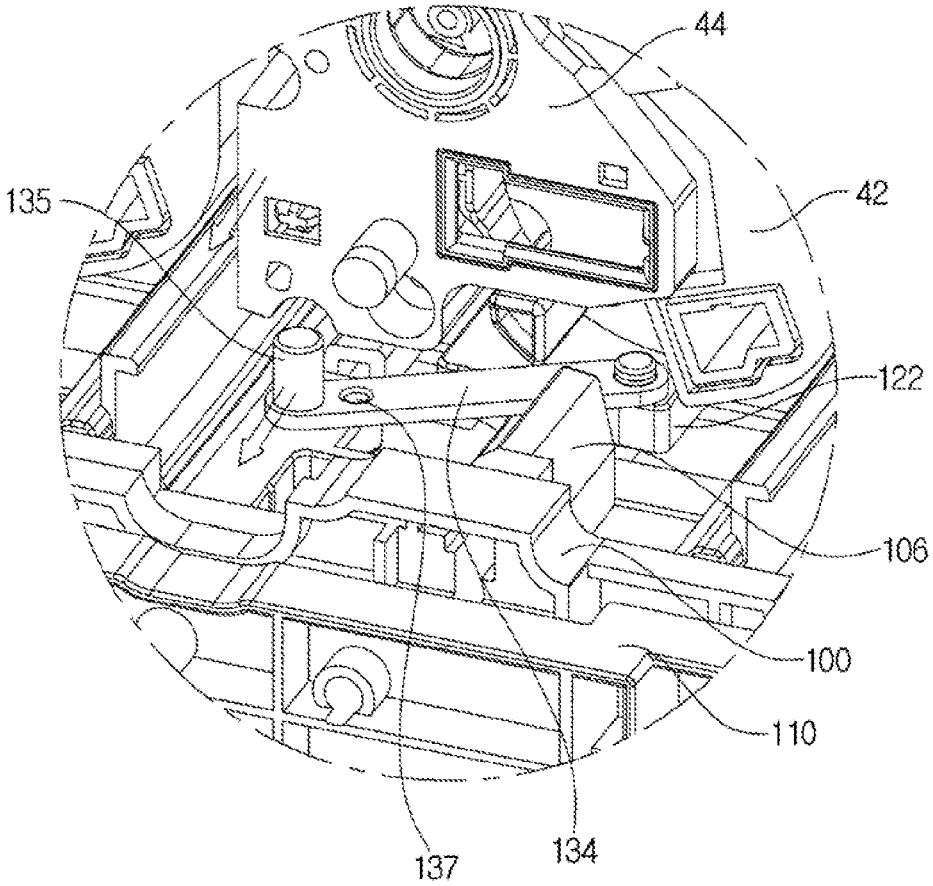
FIG. 7 is a view illustrating operations of the cleaning member when the developing devices are mounted according to an exemplary embodiment.

FIG. 2 is a perspective view illustrating some constituent elements of the image forming apparatus according to an exemplary embodiment. FIG. 3 is a perspective view illustrating some constituent elements of the image forming apparatus according to an exemplary embodiment. FIGS. 4 and 5 are views illustrating operations of a pressure member according to an exemplary embodiment. FIG. 6 is a view illustrating a pressure member, a developing device, and a cleaning member of the image forming apparatus according to an exemplary embodiment. FIG. 7 is a view illustrating operations of the cleaning member when the developing devices are mounted according to an exemplary embodiment.

The pressure member 100 may be interoperable with the opening or closing operation of the shutter unit 120 or the contact or separation between the photoconductors 45 and the developing rollers 43.

The pressure member 100 may receive power from the motor 162, and may move forward or backward due to the configuration of a cam unit (not shown).

The pressure member 100 may press the developing device 40 as described above so that the developing rollers 43 can be separated from the photoconductors 45. Thereafter, the pressure member 100 operates the shutter unit 120 to open or close the light window 35 as well as to clean the light window 35.

The pressure member 100 may move between a first position 100*a* and a second position 100*b*. If the pressure member 100 is located at the first position 100*a*, the photoconductors 45 and the developing rollers 43 may contact each other, and the shutter unit 120 may open the light window 35. If the pressure member 100 is located at the second position 100*b*, the photoconductors 45 may be separated from the developing rollers 43, and the shutter units may close the light window 35.

In other words, the pressure member 100 moves from the first position 100*a* to the second position 100*b* along a first direction w1, separates the photoconductors 45 from the developing rollers 43 by pressing the developing device 40, and closes the light window 35 by pressing the shutter unit 120. In addition, the pressure member 100 moves from the second position 100*b* to the first position 100*a* along a second direction w1 opposite to the first direction w1 so as to release pressure applied to the developing device 40 so that the photoconductors 45 and the developing rollers 43 contact each other. The pressure member 100 releases pressure applied to the shutter unit 120 so as to open the light window 35.

The developing units 42Y, 42M, 42C, and 42K are pressed by the plurality of pressure members 100. The pressed parts of the developing units 42Y, 42M, 42C, and 42K are arranged opposite to the developing rollers 43 on the basis of the centers of rotation CY, CM, CC, and CK of the respective developing units 42Y, 42M, 42C, and 42K. In more detail, separation protrusions 49 of the developing units 42Y, 42M, 42C, and 42K are located opposite to the developing rollers 43 on the basis of the centers of rotation CY, CM, CC, and CK of the respective developing units 42Y, 42M, 42C, and 42K.

When the pressure members 100 moves along the first direction w1 from the first position 100*a* to the second position 100*b*, the separation protrusions 106 press the developing units 42Y, 42M, 42C, and 42K in such a manner that the respective developing units 42Y, 42M, 42C, and 42K are rotated on the basis of the centers of rotation CY, CM, CC, and CK, thereby causing contact of the developing rollers 43 located above the centers of rotation CY, CM, CC and CK with the photoconductors 45.

The pressure member 100 may include a pressure-member main body 102 and a pressure protrusion 106.

The pressure-member main body 102 is configured to receive power from the power unit 160 in such a manner that the pressure-member main body 102 moves forward or backward.

The pressure-member main body 102 moves while simultaneously adhering closely to the fixing member 110 fixed to the image forming apparatus. The fixing member 110 may be configured to guide movement of the pressure member 100 at one side of the pressure member 100.

In more detail, a guide protrusion 112 is provided at the fixing member 110 in such a manner that the pressure-member main body 102 is prevented from escaping from a rectilinear movement, and a guide hole 104 including a rail guiding the guide protrusion 112 is provided at the pressure-member main body 102. The guide protrusion 112 moves forward or backward along the guide hole 104, so that the pressure-member main body 102 can stably move without being separated from the rectilinear movement.

The fixing member 110 may include a position control sensor 114 configured to detect a distance difference between a first position of the fixing member 110 and a second position that corresponds to a first position of the pressure member 100 and changes in response to the movement of the pressure member 100. It is possible to detect whether the pressure member 100 operates through the configuration of the position control sensor 114, and power transmission can be adjusted through a controller (not shown).

The pressure protrusion 105 may protrude from the pressure-member main body 102 to press the developing device 40, and may operate the shutter unit 120. The image forming apparatus according to the embodiment includes a plurality of developing devices 40, and may include a plurality of pressure protrusions 106 corresponding to the plurality of developing devices 40.

In more detail, the pressure protrusion 106 moves forward or backward along with the pressure-member main body 102 so as to press or release the developing units 42Y, 42M, 42C, and 42K of the developing device 40, such that the photoconductors 45 and the developing rollers 43 are separated from each other or contact each other, and at the same time the shutter unit 120 is pressed or released so that the light window 35 is opened or closed.

The pressure protrusion 106 may be configured in the form of a plate. In more detail, the pressure protrusion 106 may include a pressed surface 106*a* configured to contact both the developing device 40 and the shutter unit 120 in such a manner that the developing device 40 and the shutter unit 120 can be pressed.

In accordance with the embodiments, the developing device 40 is located above the shutter unit 120, an upper part of the pressed surface 106*a* is configured to press the developing device 40, and a lower part of the pressed surface 106*a* is configured to press the shutter unit 120.

In more detail, the pressure protrusion 106 may press not only the pressed part 127 provided at the shutter unit 120 to rotate the shutter unit 120, but also the separation protrusion 49 provided at the developing device 40 to separate the photoconductors 45 from the developing rollers 43. The pressed part 127 and the separation protrusion 49 are simultaneously pressed by the pressure protrusion 106, so that rotation of the developing units 42Y, 42M, 42C, and 42K and rotation of the shutter unit 120 can be simultaneously achieved through the rectilinear movement.

The shutter unit 120 may be provided to open or close the light window 35. The shutter unit 120 may be provided to correspond to the light window 35 so as to open or close the light window 35 in response to operations.

In accordance with the embodiments, the developing device 40 is located above the light scanning unit and the shutter unit 120 is disposed between the developing device 40 and the light scanning unit, so that the light window 35 is not contaminated by toners leaked from the developing device 40.

The shutter unit 120 may include a shutter-unit main body 122, light guide holes 124 and 104, a light guide surface 125, and a pressed part 127.

The shutter-unit main body 122 is arranged in a longitudinal direction of the light window 35 so as to close the light window 35 in response to the movement of the shutter unit 120. The light guide hole 124 may be provided to correspond to the light window 35 of the shutter-unit main body 122, and may also be configured to open the light window 35 in response to operations of the shutter unit 120.

The shutter unit 120 may rotatably move among a standby position P0 arranged when the developing device 40 is not mounted to the image forming apparatus, an open location P1 at which the light window 35 is opened, and a close position P2 at which the light window 35 is closed.

In this case, if the shutter unit 120 is located at the standby position P0 and the close position P2, the light window 35 may be covered with the shutter-unit main body 122. If the shutter unit 120 is located at the open window P1, the light guide hole 124 and the light window 35 are located at the same position, so that light from the light window 35 may arrive at the photoconductors 45.

Each light guide hole 124 may be formed by the light guide surface 125 provided at the shutter-unit main body 122. The light guide hole 124 may be enclosed by the light guide surface 125, and the light guide surface 125 may enable the light from the light window 35 to arrive at the photoconductors without scattering thereof.

The shutter unit 120 may further include the pressed part 127.

The pressed part 127 is pressed by the pressure protrusion 106 of the pressure member 100, and may be elongated from the shutter-unit main body 122. In more detail, the pressed part 127 may protrude from the shutter unit 120 in such a manner that the pressed part 127 is pressed by the pressure protrusion 106 in response to movement from the first position 100*a* of the pressure member 100 to the second position 100*b*. The pressed part 127 may include a pressed surface 106*a* corresponding to the pressed surface 106*a* of the pressure protrusion 106.

The shutter unit 120 may further include a link device 130.

The link device 130 may be provided to rotate the shutter-unit main body 122. The link device 130 is provided at both ends of the shutter-unit main body 122 so that the shutter-unit main body 122 moves in parallel.

The link device 130 may include a first link member 132 located upstream of the direction along which the developing device 40 is mounted and a second link member 134 located downstream of the direction along which the developing device 40 is mounted.

If the pressure protrusion 106 presses or releases the pressed part 127, the link device 130 rotates to operate the shutter unit 120.

A mounting protrusion 135 may be provided at the second link member 134. The mounting protrusion 135 may be protruded in such a manner that the mounting protrusion 135 is pressed by the developing device 40 when the developing device 40 is mounted and thus the shutter unit 120 moves from the standby position P0 to the open position P0. Although the mounting protrusion 135 can be provided at the first link member 132 without any problems, if the mounting protrusion 135 is arranged at the second link member 134 located downstream of the mounting direction of the developing device 40, the shutter unit 120 operates just before installation of the developing device 40 so as to open the light window 35, such that the shutter unit 120 can minimize contamination of the light window 35 by foreign material or toner of the developing device 40.

The shutter unit 120 moves from the standby position P0 to the open position P1 due to installation of the developing device 40. Thereafter, the shutter unit 120 may move to the open position P1 or the close position P2 due to the operation of the pressure member 100. The shutter unit 120 is pressed by the pressure member 100 and thus moves from the open position P1 to the close position P2. If the shutter unit 120 is released from the pressure member 100, the shutter unit 120 moves to the open position P1 indicating the original position by an elastic member (not shown) provided at the shutter unit 120.

One end of the link device 130 is rotatably coupled to the shutter unit 120, and the mounting protrusion 135 may be located at the other end thereof. The link rotation unit 137 indicating the center of rotation of the link device 130 may be disposed between one end and the other end of the link device 130.

The link rotation unit 137 may be directly supported by the main body or may be directly supported by the light scanning unit. The shutter unit 120 may be rotated on the basis of the light window 35, however, the link rotation unit 137 may be provided to be rotated or supported by a developer tray 150 coupled to the developing device 40.

The shutter unit 120 may further include a cleaning member 140.

The cleaning member 140 may be provided to correspond to the light window 35 in such a manner that the cleaning member 140 can remove foreign materials or toners accumulated on the light window 35 in response to the movement of the shutter unit 120. The cleaning member 140 may be located downstream of the light guide hole 124 when the shutter unit 120 moves from the open position P1 to the close position P2.

The shutter unit 120 may include a seating unit 142 in which the cleaning member 140 is seated. The seating unit 142 may be provided in a longitudinal direction of the light guide hole 124 so that the entire region of the light window 35 can be cleaned.

Although there is no limitation as to material types of the cleaning member 140, the cleaning member 140 is formed of an elastic material, so that the cleaning member 140 can also clean the light window 35 protruded from the light scanning unit or a concave light window 35.

Since the cleaning member 140 is provided at the shutter unit 120, it is not necessary to clean the light window 35 through additional configuration. The cleaning member 140 can clean the light window 35 while simultaneously operating in response to the developing device 40 or the shutter unit 120 so that the cleaning member 140 can prevent image defects from occurring and can perform automatic cleaning while simultaneously operating the image forming apparatus.

The power unit 160 may apply power to the pressure member 100 in such a manner that the pressure member 100 moves forward or backward.

The power unit 160 may include a motor 162 and a power clutch 164. At least one reduction gear may be disposed between the motor 162 and the pressure member 100, and may allow the power to be selectively applied by the power clutch 164. There is no limitation as to the structure of the power unit 160, and the power unit 160 may be configured to apply power generated by the motor 162 to the pressure member 100 so that the pressure member 100 can properly move forward or backward.

An intermittent gear configured to receive power from the motor 162 and a transmission gear configured to apply power to the pressure member 100 have the same rotation axis and are in close contact with each other. The power clutch 164 may be configured to selectively control the intermittent gear in response to an electric signal.

A gear elastic member may be disposed between the intermittent gear and the transmission gear, and no teeth may be formed in at least some parts of the intermittent gear and the transmission gear. If the intermittent gear is regulated by the power clutch 164 through the above-mentioned configuration, the transmission gear is regulated by the gear elastic member. In addition, if some parts including no teeth coincide with each other, no power is applied to the intermittent gear and the transmission gear. If the intermittent gear is released by the power clutch 164, some parts including no teeth of the intermittent gear and the transmission gear are dislocated, resulting in implementation of power transmission. The configuration of the power clutch 264 is not limited thereto, and can also be applied to various examples capable of converting rotation of the motor 162 serving as the power source into a rectilinear movement of the pressure member 100.

Operations of the above-mentioned image forming apparatus will hereinafter be described in detail.

Figure 8:
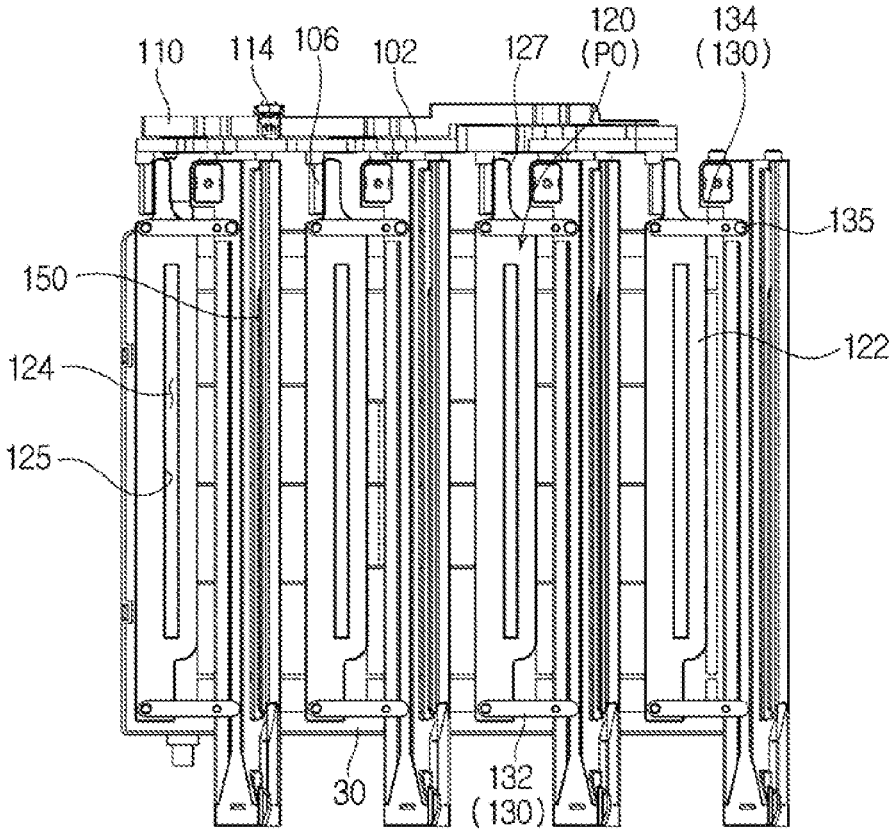
FIGS. 8 to 10 are views illustrating operations of the cleaning member according to an exemplary embodiment.
Figure 12A:
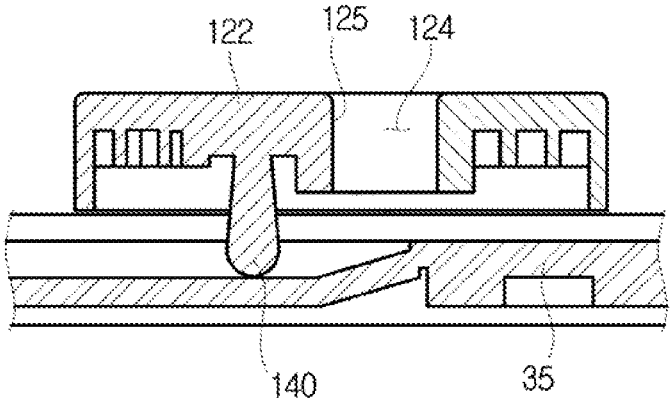
FIGS. 12A-12C are views illustrating operations of the cleaning member according to an exemplary embodiment.

FIG. 8 is a view illustrating internal constituent elements of the image forming apparatus before the developing device 40 is mounted. If the developing device 40 is not mounted as shown in FIG. 8, the shutter unit 120 may stay in the standby position P0. In this case, the shutter unit 120 is not pressed by the pressure protrusion 106, and the shutter 120 may maintain its own initial status by the elastic member. The cleaning member 140 of the shutter unit 120 may not affect the light window 35 as shown in FIG. 12A, so that the cleaning-member status before passing through the light window 35 can be maintained.

Figure 9:
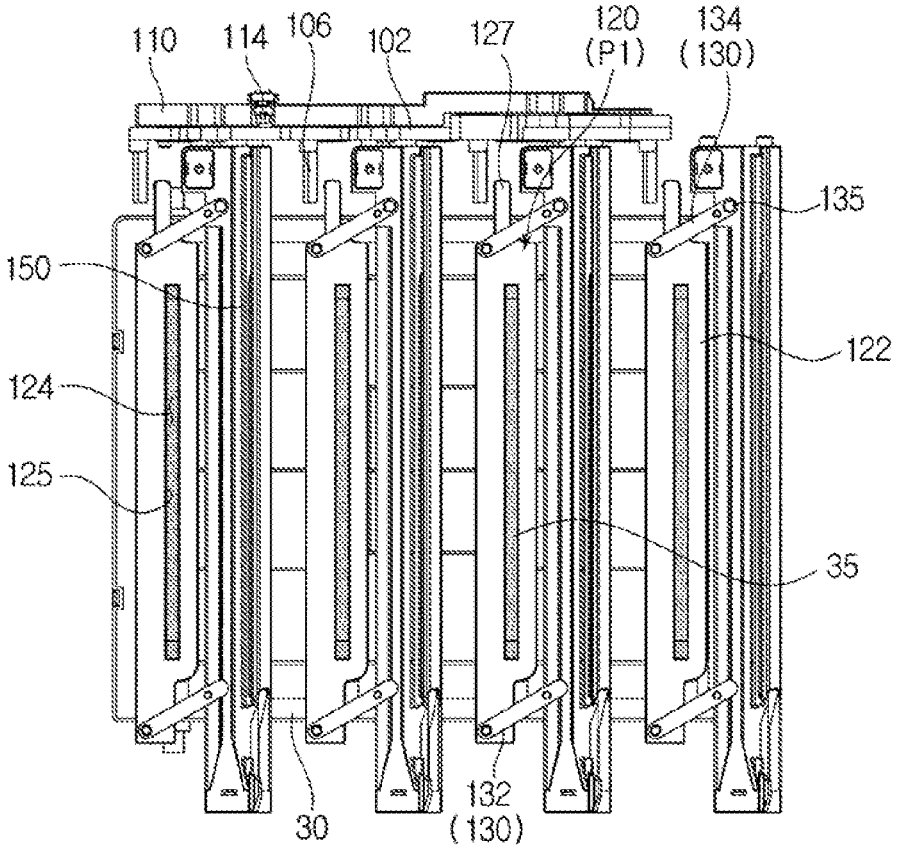

FIG. 9 is a view illustrating internal constituent elements of the image forming apparatus after the developing device 40 is mounted.

If the developing device 40 is mounted as shown in FIG. 9, the shutter unit 120 moves from the standby position P0 to the open position P1. In more detail, if the developing device 40 is mounted, the mounting protrusion 135 provided at the second link member 134 of the shutter unit 120 may press the developing device 40. As the link device 130 moves by a predetermined angle, the shutter unit 120 moves to the open position P1 so as to open the light window 35.

Therefore, the light window 35 is opened simultaneously with mounting of the developing device 40, so that the image forming apparatus is ready to operate.

Figure 12B:
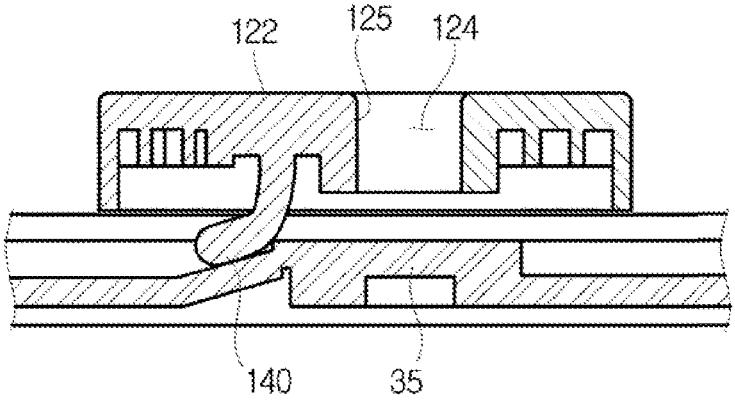

The cleaning member 140 of the shutter unit 120 may not affect the light window 35 as shown in FIG. 12B, so that the cleaning-member status before passing through the light window 35 can be maintained.

Figure 10:
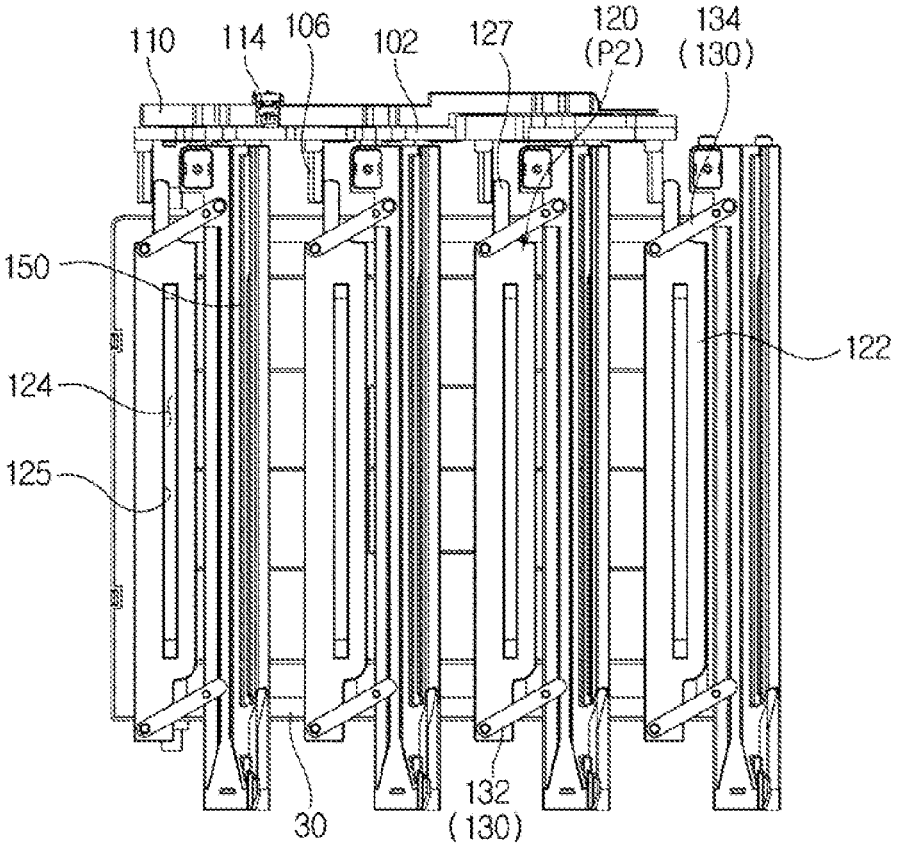
Figure 11:
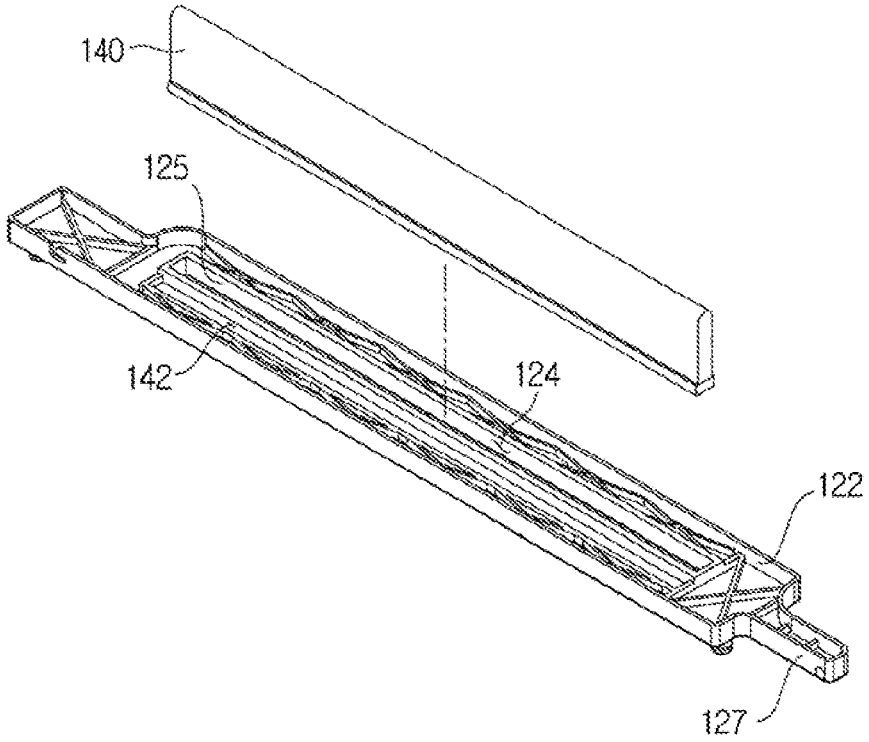
FIG. 11 is a perspective view illustrating a lower part of the cleaning member according to an embodiment.

FIG. 10 is a view illustrating internal constituent elements of the image forming apparatus when the developing device 40 and the shutter unit 120 are pressed by the pressure member 100.

If the developing device 40 and the shutter unit 120 are pressed by the pressure member 100, as shown in FIG. 10, the developing device 40 is configured to separate the developing rollers 43 from the photoconductors 45, and the shutter unit 120 may be configured to close the light window 35.

Toner leakage caused by separation between each developing roller 45 and each photoconductor 45 may not affect the light window 35, so that the light window 35 is not contaminated.

In addition, the developing device 40 and the shutter unit 120 are simultaneously operated through the pressure member 100, so that they can be more effectively controlled as compared to exemplary cases in which each of the developing device 40 and the shutter unit 120 is controlled and the developing device 40 and the shutter unit 120 are interoperable with each other.

Figure 12C:
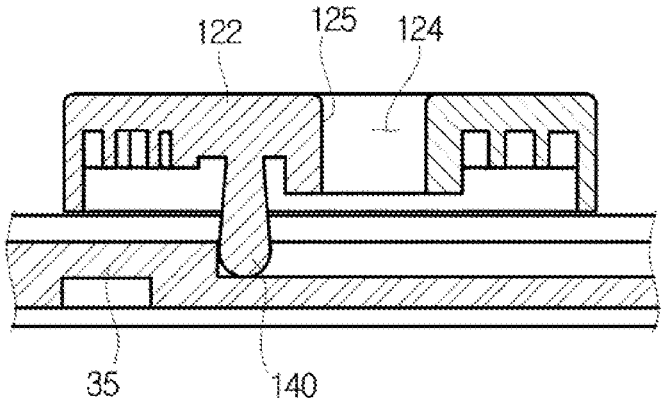

The cleaning member 140 of the shutter unit 120 may be configured to pass through the light window 35 as shown in FIG. 12C, so that the surface of the light window 35 is cleaned and cleanliness of the light window 35 can be maintained.

Although the shutter unit 120 can be operated in response to the installation of the developing device 40 and the movement of the pressure member 100, it should be noted that the shutter unit 120 can also be operated through additional control so that foreign materials attached to the light window 35 can be removed.

As is apparent from the above description, the image forming apparatus according to the embodiments can open or close the light window and can also clean the light window without addition of other configurations, resulting in a simplified structure of the image forming apparatus. In addition, the light window can be periodically cleaned, resulting in improvement of image quality.

Although a few embodiments have been shown and described, it would be appreciated by those skilled in the art that changes may be made in these embodiments without departing from the principles and spirit of the disclosure, the scope of which is defined in the claims and their equivalents.

What is claimed is:

1. An image forming apparatus comprising:

a main body;

a developing device which includes a photoconductor and a developing roller that forms a visible image by applying a toner to the photoconductor on which an electrostatic latent image is formed and is detachably coupled to the photoconductor;

a light scanner which includes a light source which generates light to form the electrostatic latent image by applying the light to the photoconductor, and a light window which transmits the light generated by the light source;

a shutter which is rotatably moved among a standby position, an open position at which the light window is opened after being moved from the standby position to allow installation of the developing device, and a close position at which the light window is closed; and a pressure member which includes a pressure-member main body provided to move forward or backward between a first position and a second position, and a pressure protrusion provided to press the shutter and the developing device, wherein the pressure-member main body is interoperable with an opening or closing operation of the shutter or a contact or separation between the photoconductor and the developing roller, wherein the shutter includes:

a shutter main body to open or close the light window; and a link device rotatably coupled to the shutter main body so that the link device rotatably moves among the standby position, the open position, and the close position, and wherein the link device includes a mounting protrusion pressed by the developing device when the developing device is mounted so that the shutter is protruded to move from the standby position to the open position.

2. The image forming apparatus according to claim 1, wherein:

at the first position, the photoconductor and the developing roller contact each other and the shutter opens the light window; and at the second position, the photoconductor and the developing roller are separated from each other and the shutter closes the light window.

3. The image forming apparatus according to claim 1, wherein:

the pressure member separates the photoconductor from the developing roller by pressing the developing device after moving in a first direction, and closes the light window by pressing the shutter; and the pressure member releases pressure applied to the developing device by moving to a second direction opposite to the first direction so that the photoconductor and the developing roller contact each other, and opens the light window by releasing pressure applied to the shutter.

4. The image forming apparatus according to claim 1, wherein:

the shutter includes a pressed part pressed through the pressure protrusion such that the shutter is opened or closed, the developing device includes a separation protrusion pressed through the pressure protrusion so that the developing roller and the photoconductor contact each other or are separated from each other, and the pressed part and the separation protrusion are pressed by the pressure protrusion in response to movement of the pressure member moving from the open position to the close position.

5. The image forming apparatus according to claim 4, wherein the pressure protrusion simultaneously presses the pressed part and the separation protrusion.

6. The image forming apparatus according to claim 1, wherein:

the developing device includes:

a photoconductor unit which includes the photoconductor; and a developing unit which includes the developing roller, and which rotatably provided at the photoconductor unit so that the photoconductor and the developing roller contact each other or are separated from each other by the pressure member, and the pressure member rotates the developing unit by pressing one side of the developing unit such that the developing roller and the photoconductor are separated from each other.

7. The image forming apparatus according to claim 1, wherein the shutter rotatably moves between the open position and the close position due to movement of the pressure member.

8. The image forming apparatus according to claim 7, wherein:

the link device includes:

a first link member located upstream of a direction along which the developing device is mounted; and a second link member located downstream of the direction along which the developing device is mounted, and the mounting protrusion is provided at the second link member.

9. The image forming apparatus according to claim 1, wherein the shutter further includes a light guide hole provided in the shutter main body so that light transmitted through the light window passes through the light guide hole.

10. The image forming apparatus according to claim 9, wherein:

the shutter unit further includes a cleaning member corresponding to the light window so as to clean the light window in response to rotation of the shutter.

11. The image forming apparatus according to claim 10, wherein:

the shutter rotatably moves between the open position at which the light window is opened and the close position at which the light window is closed, and the cleaning member is located downstream of the light guide hole in response to movement of the shutter configured to move from the open position to the close position.

12. The image forming apparatus according to claim 1, further comprising:

a motor to generate power; and a power clutch to selectively apply power generated by the motor to the pressure member.

13. The image forming apparatus according to claim 1, wherein the developing device is detachably coupled to an upper part of the light scanner, and the shutter is disposed between the developing device and the light scanner.

14. The image forming apparatus according to claim 1, further comprising:

a fixing member to guide movement of the pressure member at one side of the pressure member; and a position control sensor to detect a distance difference between a first position of the fixing member and a second position corresponding to the first position of the pressure member.

15. An image forming apparatus comprising:

a main body;

a photoconductor unit including a photoconductor;

a developing unit, rotatably coupled to the photoconductor unit, the developer unit includes a developing roller that forms a visible image by applying a toner to the photoconductor on which an electrostatic latent image is formed so that the developing roller is detachably coupled to the photoconductor, and a separation protrusion pressed so that the developing unit rotates;

a light scanner which includes a light source which generates light to form an electrostatic latent image by applying the light to the photoconductor, a light window which transmits the light generated by the light source;

a shutter which is rotatably provided to open or close the light window, and which includes a pressed part configured to be pressed so that the shutter rotatably moves; and a pressure member which includes a pressure-member main body provided to be rotatably moved forward or backward, and a pressure protrusion which protrudes from the pressure-member main body to press the separation protrusion and the pressed part, wherein the shutter includes:

a shutter main body to open or close the light window;

a link device which is rotatably coupled to the shutter main body, and which is rotatably moved among a standby position, an open position at which the light window is opened when the link device moves from the standby position due to installation of the developing device, and a close position at which the light window is closed, and wherein the link device includes a mounting protrusion pressed by the developing device when the developing device is mounted so that the shutter is protruded to move from the standby position to the open position.

16. The image forming apparatus according to claim 15, wherein the shutter moves from the standby position to the open position when the developing device is mounted, and moves between the open position and the close position when the pressure member moves forward or backward.

17. An image forming apparatus comprising:

a main body;

a developing device which includes a photoconductor and a developing roller that forms a visible image by applying a toner to the photoconductor on which an electrostatic latent image is formed and is detachably coupled to the main body;

a light scanner which includes a light source which generates light to form the electrostatic latent image by applying the light to the photoconductor, and which transmits the light generated by the light source; and a shutter which is rotatably moved among a standby position achieved when the developing device is not mounted, an open position at which the light window is opened, and a close position at which the light window is closed, and moved from the standby position to the open position in response to movement of the developing device mounted to the main body, wherein the shutter includes:

a shutter main body corresponding to the light window such that the light window is opened or closed;

a link device configured to include not only a first link member located upstream of a direction along which the developing device is mounted, but also a second link member located downstream of the direction along which the developing device is mounted, such that the shutter is rotatably moved among the standby position, the open position, and the close position; and a mounting protrusion provided at the second link member, and pressed by the developing device due to installation of the developing device so that the shutter is rotatably moved from the standby position to the open position.

18. The image forming apparatus according to claim 17, further comprising:

a photoconductor unit including the photoconductor; and a developing unit which includes the developing roller, and which is rotatably coupled to the photoconductor unit so that the photoconductor and the developing roller are in contact with each other or separated from each other by the pressure member.

19. The image forming apparatus according to claim 18, further comprising:

a pressure member to press the developing unit and the shutter in a first direction so that the photoconductor and the developing roller are separated from each other and the shutter closes the light window, and to release pressure applied to the developing unit and the shutter unit in a second direction opposite to the first direction so that the photoconductor contacts the developing roller and the shutter opens the light window.

20. The image forming apparatus according to claim 19, wherein the pressure member includes:

a pressure-member main body configured to move forward or backward; and a pressure protrusion protruded from the pressure-member main body to face the shutter and the developer, thereby pressing the shutter and the developing unit.

21. The image forming apparatus according to claim 17, wherein the shutter includes a cleaning member arranged to correspond to the light window so as to clean the light window in response to movement of the shutter which moves between the open position and the close position.

* * * * *